US010125797B2

(12) United States Patent
Slattery et al.

(10) Patent No.: US 10,125,797 B2
(45) Date of Patent: Nov. 13, 2018

(54) VENT FOR LOAD SENSE VALVES

(71) Applicant: Parker-Hannifin Corporation, Cleveland, OH (US)

(72) Inventors: Brian Slattery, Hicksville, OH (US); Kevin Lawrence Bresnahan, Avon Lake, OH (US)

(73) Assignee: Parker-Hannifin Corporation, Cleveland, OH (US)

( * ) Notice: Subject to any disclaimer, the term of this patent is extended or adjusted under 35 U.S.C. 154(b) by 389 days.

(21) Appl. No.: 14/858,545

(22) Filed: Sep. 18, 2015

(65) Prior Publication Data

US 2016/0145834 A1 May 26, 2016

Related U.S. Application Data

(60) Provisional application No. 62/082,910, filed on Nov. 21, 2014.

(51) Int. Cl.

| | |
|---|---|
| ***E02F 9/22*** | (2006.01) |
| ***F15B 13/04*** | (2006.01) |
| ***F15B 11/16*** | (2006.01) |

(52) U.S. Cl.

CPC ..... *F15B 13/0417* (2013.01); *F15B 11/165* (2013.01); *E02F 9/2225* (2013.01); *E02F 9/2232* (2013.01); *E02F 9/2267* (2013.01); *F15B 2211/6052* (2013.01); *F15B 2211/65* (2013.01)

(58) Field of Classification Search

CPC .. F15B 11/0445; F15B 13/02; F15B 13/0417; F15B 13/08; F15B 2211/20553; F15B 2211/40515; F15B 2211/71

See application file for complete search history.

(56) References Cited

U.S. PATENT DOCUMENTS

| | | | | | |
|---|---|---|---|---|---|
| 3,881,512 | A * | 5/1975 | Wilke | F15B 11/16 | 137/596.13 |
| 3,929,159 | A * | 12/1975 | McAvoy | F15B 13/01 | 137/596.13 |
| 5,315,826 | A * | 5/1994 | Hirata | E02F 9/2232 | 60/422 |
| 5,699,665 | A * | 12/1997 | Coolidge | E02F 9/2225 | 60/426 |
| 8,215,107 | B2 * | 7/2012 | Pfaff | F15B 11/055 | 60/424 |
| 2008/0000535 | A1 * | 1/2008 | Coolidge | F15B 13/0417 | 137/625.69 |
| 2010/0320406 | A1 * | 12/2010 | Matsuo | G05D 7/0635 | 251/129.01 |
| 2015/0101676 | A1 * | 4/2015 | Knapper | G05D 16/106 | 137/102 |

* cited by examiner

*Primary Examiner* — F. Daniel Lopez
*Assistant Examiner* — Matthew Wiblin
(74) *Attorney, Agent, or Firm* — McDonnell Boehnen Hulbert & Berghoff LLP

(57) ABSTRACT

A load sense passage in a load sense hydraulic system may be vented by allowing flow from the load sense passage to a reservoir via a drain passage when a first flow control valve is in a neutral position. This venting may be prevented by preventing flow from the load sense passage to a reservoir via the drain passage when the first flow control valve is in a flow-allowing position.

16 Claims, 2 Drawing Sheets

VENT FOR LOAD SENSE VALVES

This application claims the benefit of U.S. Provisional Application No. 62/082,910 filed Nov. 21, 2014 which is hereby incorporated herein by reference in its entirety.

FIELD OF INVENTION

The present invention relates generally to load sense valves, and more particularly to a vent mechanism for use in mobile load sense and pressure compensated load sense directional valves.

BACKGROUND

In mobile Load Sense (LS) and Load Sense Pressure Comp (LSPC) valves, two types of load sense signal control are typical for transmitting the highest load signal to the hydraulic system. Either a single-seat check can be used to transmit the highest pressure from the several hydraulic functions to the pump LS signal line, or a shuttle check may be used. Regardless, the LS signal must be vented to ensure that high pressure is not trapped in the pump LS signal line when spools of the work functions are in neutral and no work is required.

SUMMARY OF INVENTION

In conventional systems, a single seat check responds faster than a shuttle check, but the only way to bleed the signal is to vent oil away at all times when pressurized. The venting circuit is such that the valve is always losing some of the LS signal back to a tank or reservoir, especially at high pressure. Further, the vent is typically a tiny hole which needs a screen for preventing contaminants from blocking the hole. This increases costs more than what might be at first apparent. A shuttle system for the LS signal is more complicated and expensive, and the signal also needs to be vented through internal passages in the main control spool. This results in higher pressure drop in the LS circuit.

In contrast, exemplary systems utilize the single seat check design which is less expensive than a shuttle. Exemplary systems have a less complicated circuit than conventional systems. The LS signal in exemplary systems does not have a constant flow loss through the vent when spools are actuated, thus the LS signal is more stable and consistent. Finally, exemplary systems are less expensive to manufacture than conventional systems.

In particular, exemplary systems have a separate LS passage the length of the valve assembly, which interacts with an undercut on each control spool in the valve assembly. When the spools are in their neutral position the LS passage is connected to tank, properly venting the LS signal. When any spool is shifted, the LS signal vent path is blocked by that spool, and the LS signal from the highest loaded section creates the LS signal to the hydraulic system. With no vent connection across the shifted spool undercut, pressure is trapped in the circuit and the pump will not de-stroke.

According to one aspect of the invention, a load sense hydraulic system includes a load sense passage communicating load sense pressure from a first hydraulic valve to a variable capacity hydraulic pump; a first load sense check valve disposed between the first hydraulic valve and the load sense passage and configured to allow flow from a flow portion of the first hydraulic valve to the load sense passage and block flow from the load sense passage to the flow portion of the first hydraulic valve; and the first hydraulic valve having a neutral position and a flow position, wherein in the neutral position, the first hydraulic valve closes the flow portion of the first hydraulic valve, preventing flow from a flow inlet of the first hydraulic valve towards a first work port of the first hydraulic valve, and opens a load sense portion, allowing flow from the load sense passage towards a drain passage, and wherein in the flow position, the hydraulic valve opens the flow portion of the first hydraulic valve, allowing flow from the flow inlet to the first work port of the first hydraulic valve, and closes the load sense portion, preventing flow from the load sense passage toward the drain passage.

Optionally, the load sense hydraulic system also includes a second hydraulic valve from which the load sense passage also communicates load sense pressure to the variable capacity pump; a second load sense check valve disposed between the second hydraulic valve and the load sense passage and configured to allow flow from a flow portion of the second hydraulic valve to the load sense passage and block flow from the load sense passage to the flow portion of the second valve section; and a second hydraulic valve having a neutral position and a flow position, wherein in the neutral position, the second hydraulic valve closes the flow portion of the second hydraulic valve, preventing flow from a flow inlet of the second hydraulic valve towards a first work port of the second hydraulic valve, and opens a load sense portion of the second hydraulic valve, allowing flow from the load sense passage towards the drain passage, and wherein in the flow position, the second hydraulic valve opens the flow portion of the second hydraulic valve, allowing flow from the flow inlet of the second hydraulic valve to the first work port of the second hydraulic valve, and closes the load sense portion of the second hydraulic valve, preventing flow from the load sense passage toward the drain passage.

Optionally, the first hydraulic valve has a second flow position, and wherein in the second flow position the first hydraulic valve opens the flow portion of the first hydraulic valve, allowing flow from the flow inlet of the first hydraulic valve to a second work port of the first hydraulic valve, and closes the load sense portion of the first hydraulic valve, preventing flow from the load sense passage to the drain passage.

Optionally, the second hydraulic valve has a second flow position, and wherein in the second flow position the second hydraulic valve opens the flow portion of the second hydraulic valve, allowing flow from the flow inlet of the second hydraulic valve to a second work port of the second hydraulic valve, and closes the load sense portion of the second hydraulic valve, preventing flow from the load sense passage to the drain passage.

Optionally, the first hydraulic valve is a spool valve.

Optionally, the second hydraulic valve is a spool valve.

Optionally, the first hydraulic valve includes a bore, the inlet and first work port opens into the bore of the first hydraulic valve at the flow portion of the first hydraulic valve; a spool axially moveable in the bore, the spool including a first reduced diameter portion at the flow portion that is configured to selectively fluidly connect the inlet to the first work port, the spool further including a reduced diameter portion at the load sense portion to selectively fluidly connect an upstream load sense drain opening to a downstream load sense drain opening.

Optionally, the second work port of the first hydraulic valve opens into the bore at the flow portion of the first hydraulic valve, and wherein the spool is axially moveable in the bore and includes a second reduced diameter portion at the flow portion that is configured to selectively fluidly connect the inlet to the second work port.

Optionally, the second hydraulic valve includes a bore, the inlet and first work port of the second hydraulic valve opens into the bore of the second hydraulic valve at the flow portion of the second hydraulic valve; a spool axially moveable in the bore, the spool including a first reduced diameter portion at the flow portion and configured to selectively fluidly connect the inlet to the first work port, the spool further including a reduced diameter portion at the load sense portion to selectively fluidly connect an upstream load sense drain opening to a downstream load sense drain opening.

Optionally, the second work port of the second hydraulic valve opens into the bore at the flow portion of the second hydraulic valve, and wherein the spool is axially moveable in the bore and includes a second reduced diameter portion at the flow portion of the second hydraulic valve that is configured to selectively fluidly connect the inlet of the second hydraulic valve to the second work port of the second hydraulic valve.

Optionally, the downstream load sense drain opening of the first hydraulic valve is fluidly connected to the upstream load sense drain opening of the second hydraulic valve.

Optionally, the downstream load sense drain opening of the second hydraulic valve is fluidly connected to a reservoir.

Optionally, the upstream load sense drain opening of the first hydraulic valve is fluidly connected to the load sense passage.

Optionally, the first hydraulic valve has a second flow position, and wherein in the second flow position the first hydraulic valve opens the flow portion of the first hydraulic valve, allowing flow from the first work port of the first hydraulic valve to a tank return of the first hydraulic valve.

Optionally, in the first flow position the first hydraulic valve opens the flow portion of the first hydraulic valve, allowing flow from the second work port of the first hydraulic valve to a tank return of the first hydraulic valve.

Optionally, the second hydraulic valve has a second flow position, and wherein in the second flow position the second hydraulic valve opens the flow portion of the second hydraulic valve, allowing flow from the first work port of the second hydraulic valve to a tank return of the second hydraulic valve.

Optionally, in the first flow position the second hydraulic valve opens the flow portion of the second hydraulic valve, allowing flow from the second work port of the second hydraulic valve to a tank return of the second hydraulic valve.

According to another aspect, a method of venting a load sense passage in a load sense hydraulic system includes allowing flow from the load sense passage to a reservoir via a drain passage when a first flow control valve is in a neutral position; and preventing flow from the load sense passage to a reservoir via the drain passage when the first flow control valve is in a flow-allowing position.

Optionally, the allowing flow step includes allowing flow when all flow control valves fluidly connected to the load sense passage are in a neutral position; and wherein the preventing flow step includes preventing flow when any flow control valve fluidly connected to the load sense passage is in a flow-allowing position.

Optionally, the load sense hydraulic system of any of these methods is the load sense hydraulic system of any preceding paragraph and the flow control valve is the first hydraulic valve.

The foregoing and other features of the invention are hereinafter described in greater detail with reference to the accompanying drawings.

DETAILED DESCRIPTION

The principles of this present application have particular application to hydraulic actuation systems for extending and retracting at least one hydraulic cylinder in a work machine, such as a hydraulic excavator, and thus will be described below chiefly in this context. It will of course be appreciated, and also understood, that principles of this invention may be applicable to other work machines, such as wheel loaders, loading shovels, backhoe shovels, mining equipment, industrial machinery and the like, having one or more actuated components such as lifting and/or tilting arms, booms, buckets, steering and turning functions, traveling means, etc.

Figure 1:
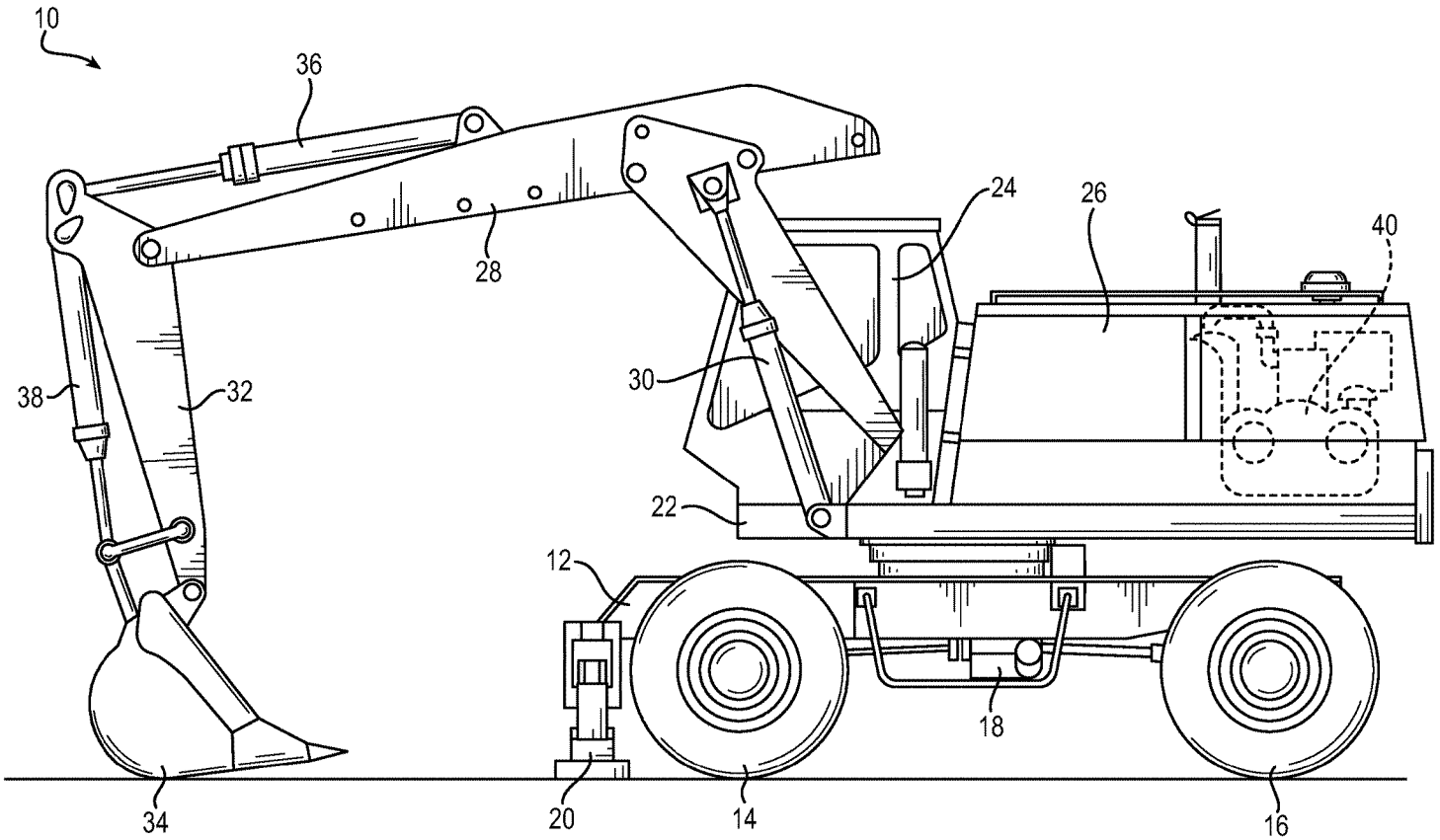
FIG. 1 shows a conventional excavator which includes an exemplary load-sense system.

Referring to the drawings, and initially to FIG. 1, an exemplary wheel-type hydraulic excavator is illustrated generally at reference numeral 10. The excavator 10 includes a body or undercarriage 12 supported on suitable front and rear wheels 14 and 16 respectively driven by a suitable hydraulic motor 18. Outriggers 20 are secured to the body 12 and extendable by suitable hydraulic actuators (not shown) into engagement with the ground to stabilize the vehicle 10 during operation. A suitable rotatable platform 22 is supported by the body 12 for rotation relative to the body by one or more hydraulic actuators, such as a swing motor 23 and includes an operator compartment 24 and an engine compartment 26. A boom 28 is pivotally mounted on the rotatable platform 22 and manipulated about its pivotal point by one or more hydraulic actuators, such as one or more piston-cylinder assemblies 30. An arm 32 is pivotally carried by the boom 28 and pivotally carries on the end thereof a bucket 34 with hydraulic actuators, such as one or more piston-cylinder assemblies 36 and 38 operatively connected for manipulating the arm 32 and bucket 34 respectively. Fluid for manipulating and controlling the hydraulic actuators is supplied by a hydraulic system 40 described below and pressurized by a pump driven by a prime mover, such as an engine.

A load sense (LS) signal in a hydraulic system must be vented to ensure that high pressure is not trapped in the pump LS signal line when spools of work functions are in neutral and no work is required. Exemplary systems may have a separate LS passage the length of the valve assembly, which interacts with an undercut on each control spool in the valve assembly. When the spools are in neutral, the LS passage is connected to tank, properly venting the LS signal. When any spool is shifted, the LS signal vent path is blocked by that spool, and the LS signal from the highest loaded section creates the LS signal to the hydraulic system. With no vent connection across the shifted spool undercut, pressure is trapped in the circuit and the pump will not de-stroke.

Figure 2:
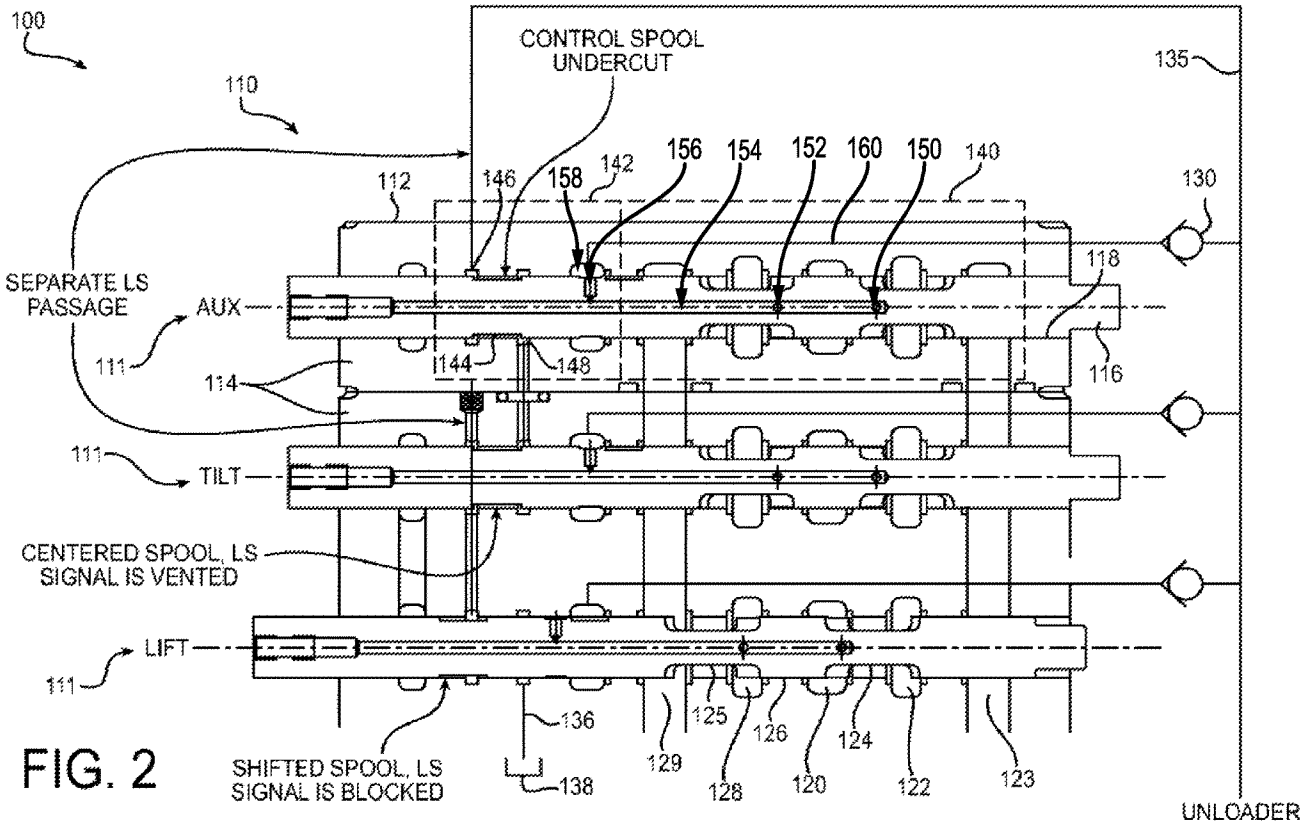
FIG. 2 shows a schematic of an exemplary hydraulic load-sense system.

Referring to FIG. 2, a schematic diagram of an exemplary hydraulic system is shown at 100. A valve assembly 110 includes one or more valves or work sections 111 that operate to control hydraulic flow to and from corresponding hydraulic functions (not shown) via work ports connecting the valve sections to the hydraulic functions. Hydraulic functions may include any appropriate functions such as hydraulic consumers such as, for example, rotary hydraulic motors, hydraulic piston/cylinder arrangements, hydraulic accumulators, or the like. As shown in FIG. 2, example hydraulic functions include but are not limited to an auxiliary function (such as, for example, stabilizer legs), a tilt function, and a lift function.

The valve assembly may include a valve body 112 which may be unitary or made up of one or more individual valve blocks 114. A valve block (or a portion of the valve body 112) may house a valve member (such as a valve spool) 116 of the valve 111. FIG. 2 depicts the valve corresponding to the auxiliary function (AUX) and the valve corresponding to the tilt function (TILT) as being in a "neutral" or "closed" position. The valve corresponding to the lift function (LIFT) is shown in an active position allowing flow from the flow inlet 120 area to a first work port area 122 via first work port undercut or reduced-diameter portion 124 of the spool 116. The spool at central land 126 blocks flow from the inlet to the second work port area 128. In the neutral position, the central land 126 blocks flow from the inlet to both work port areas 122 and 128.

Each valve 111 may also have an associated load sense check valve 130 disposed between the hydraulic valve and the load sense passage 135 and configured to allow flow from a flow portion 140 of the valve through hole 150 (or hole 152), passage 154, orifice 156, flow area 158, and passage 160 to the load sense passage 135 and block flow from the load sense passage 135 to the flow portion 140 of the first hydraulic valve. The flow portion, as detailed more below, is that portion of the valve controlling and regulating flow from the pump to the associated function and from the function to tank. The load sense passage 135 communicates load sense pressure from valve to a variable capacity hydraulic pump. Each valve may have such a check valve to communicate a signal pressure from the highest pressured work section to the pump while preventing backflow from the load sense passage back to any of the worksections.

Each hydraulic valve (of which there may be any number) includes a neutral position and at least one flow position. In the neutral position, the hydraulic valve closes the flow portion of the first hydraulic valve, preventing flow from the flow inlet 120 towards a first work port 122. Meanwhile, in a load sense portion 142 of the same valve (the load sense portion being that portion which controls flow from the load sense passage to tank) the valve opens, allowing flow from the load sense passage 135 towards a drain passage 136. The drain passage may be fluidly coupled to a reservoir 138.

In contrast, when in the flow position, the hydraulic valve opens the flow portion of the first hydraulic valve, allowing flow from the flow inlet to the first work port of the valve, and closes the load sense portion, preventing flow from the load sense passage toward the drain passage.

Because other valve sections may operate similarly and may have their load sense portions fluidly connected in series, all valves may need to be in a neutral position in order to actually cause flow from the load sense passage to the drain passage. Otherwise, any exemplary valves that are in a flow position would prevent flow along the serially connected passages from the load sense passage to the drain passage.

As shown, exemplary valves 111 may include a second flow position. When in the second flow position the hydraulic valve opens the flow portion of the first hydraulic valve, allowing flow from the flow inlet of the valve to a second work port 128 of the valve. This second position would, in many exemplary embodiments, reverse the flow from the first position and thereby reverse the hydraulic function (for example, lowering a boom rather than raising it). Meanwhile, the valve would also close the load sense portion of the valve and thereby prevent flow from the load sense passage to the drain passage.

As shown, in order to enable these functions, the spool 116 axially moveable in the bore 118. The spool includes a first reduced diameter portion 124 at the flow portion. The reduced-diameter portion is configured to selectively fluidly connect the inlet 120 to the first work port 122. The spool 116 may also include a second reduced diameter portion 125 to selectively fluidly connect the inlet 120 to the second work port 128.

in the second flow position the valve may also open the flow portion of the valve, allowing flow from the first work port 122 of the valve to a tank return 123 of the valve. The reduced-diameter portion 124 accomplishes this connection by axially moving so as to connect the work port 122 to the tank return 123. Similarly, in the first flow position the valve opens the flow portion of the valve, allowing flow from the second work port 128 of the valve to a tank return 129 of the first hydraulic valve. In this way, as shown, a valve inlet 120 may be in a central location in the flow portion 140 of the valve flanked by axially spaced work ports 122, 128 which are collectively flanked by tank returns 123, 129.

At the load sense portion 142, the spool includes a reduced diameter portion 144 to selectively fluidly connect an upstream load sense drain opening 146 to a downstream load sense drain opening 148.

The downstream load sense drain opening of one valve may be fluidly connected to the upstream load sense drain opening of another valve, for example, by a hose or, as shown, by complimentary bores in the valve body (which may, for example, be sealed at their connection point by an O-ring). Any number of valves may be serially connected this way. Further, as shown, two valves may be formed in the same unitary valve body (TILT and LIFT), and their load sense drain openings may simply be directly connected by a common bore in the valve body.

The downstream load sense drain opening of the last valve in any serially-connected grouping may be fluidly connected to a reservoir 138 via the drain passage 136.

The upstream load sense drain opening of the first valve in any serially-connected grouping may be fluidly connected to the load sense passage 135.

It is noted that, unlike constant-vent circuits, exemplary embodiments do not require a screen upstream of the vent. In this way, exemplary embodiments may be considered to reduce this complexity/cost of conventional load-sense systems.

Although the invention has been shown and described with respect to a certain embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A load sense hydraulic system comprising:

a load sense passage communicating load sense pressure from a first hydraulic valve to a variable capacity hydraulic pump, wherein the first hydraulic valve includes (i) a body defining a bore, (ii) a spool axially movable in the bore and including a reduced diameter portion extending axially along an exterior surface of the spool, (iii) an upstream load sense drain opening configured to be fluidly coupled to the load sense passage and formed as a first annular groove disposed in an interior surface of the body, and (iv) a downstream load sense drain opening configured to be coupled to a drain passage and formed as a second annular groove disposed in the interior surface of the body and axially spaced from the first annular groove; and a first load sense check valve disposed between the first hydraulic valve and the load sense passage and configured to allow flow from a flow portion of the first hydraulic valve to the load sense passage and block flow from the load sense passage to the flow portion of the first hydraulic valve, wherein the first hydraulic valve has a neutral position and a flow position, wherein in the neutral position, the first hydraulic valve closes the flow portion of the first hydraulic valve, preventing flow from a flow inlet of the first hydraulic valve towards a first work port of the first hydraulic valve, and opens a load sense portion, wherein the reduced diameter portion forms an axially extending flow passage having a first end that partially overlaps with the first annular groove and a second end that partially overlaps with the second annular groove, thereby fluidly coupling the upstream load sense drain opening to the downstream load sense drain opening and allowing flow from the load sense passage towards the drain passage, and wherein in the flow position, the first hydraulic valve opens the flow portion of the first hydraulic valve, allowing flow from the flow inlet to the first work port of the first hydraulic valve, and closes the load sense portion, preventing flow from the load sense passage toward the drain passage.

2. The load sense hydraulic system of claim 1, further comprising:

a second hydraulic valve from which the load sense passage also communicates the load sense pressure to the variable capacity hydraulic pump; and a second load sense check valve disposed between the second hydraulic valve and the load sense passage and configured to allow flow from a flow portion of the second hydraulic valve to the load sense passage and block flow from the load sense passage to the flow portion of the second hydraulic valve, wherein the second hydraulic valve having a neutral position and a flow position, wherein in the neutral position, the second hydraulic valve closes the flow portion of the second hydraulic valve, preventing flow from a flow inlet of the second hydraulic valve towards a first work port of the second hydraulic valve, and opens a load sense portion of the second hydraulic valve, allowing flow from the load sense passage towards the drain passage, and wherein in the flow position, the second hydraulic valve opens the flow portion of the second hydraulic valve, allowing flow from the flow inlet of the second hydraulic valve to the first work port of the second hydraulic valve, and closes the load sense portion of the second hydraulic valve, preventing flow from the load sense passage toward the drain passage.

3. The load sense hydraulic system of claim 2, wherein the second hydraulic valve has a second flow position, and wherein in the second flow position the second hydraulic valve opens the flow portion of the second hydraulic valve, allowing flow from the flow inlet of the second hydraulic valve to a second work port of the second hydraulic valve, and closes the load sense portion of the second hydraulic valve, preventing flow from the load sense passage to the drain passage.

4. The load sense hydraulic system of claim 2, wherein the second hydraulic valve includes:

a bore, the flow inlet and the first work port of the second hydraulic valve opens into the bore of the second hydraulic valve at the flow portion of the second hydraulic valve; and a spool axially moveable in the bore, the spool including a first reduced diameter portion at the flow portion and configured to selectively fluidly connect the flow inlet to the first work port, the spool further including a reduced diameter portion at the load sense portion to selectively fluidly connect an upstream load sense drain opening to a downstream load sense drain opening.

5. The load sense hydraulic system of claim 4, wherein a second work port of the second hydraulic valve opens into the bore at the flow portion of the second hydraulic valve, and wherein the spool is axially moveable in the bore and includes a second reduced diameter portion at the flow portion of the second hydraulic valve that is configured to selectively fluidly connect the flow inlet of the second hydraulic valve to the second work port of the second hydraulic valve.

6. The load sense hydraulic system of claim 2, wherein the downstream load sense drain opening of the first hydraulic valve is fluidly connected to an upstream load sense drain opening of the second hydraulic valve.

7. The load sense hydraulic system of claim 6, wherein a downstream load sense drain opening of the second hydraulic valve is fluidly connected to a reservoir.

8. The load sense hydraulic system of claim 2, wherein the second hydraulic valve has a second flow position, and wherein in the second flow position the second hydraulic valve opens the flow portion of the second hydraulic valve, allowing flow from the first work port of the second hydraulic valve to a tank return of the second hydraulic valve.

9. The load sense hydraulic system of claim 2, wherein in the flow position the second hydraulic valve opens the flow portion of the second hydraulic valve, allowing flow from a second work port of the second hydraulic valve to a tank return of the second hydraulic valve.

10. The load sense hydraulic system of claim 1, wherein the first hydraulic valve has a second flow position, and wherein in the second flow position the first hydraulic valve opens the flow portion of the first hydraulic valve, allowing flow from the flow inlet of the first hydraulic valve to a second work port of the first hydraulic valve, and closes the load sense portion of the first hydraulic valve, preventing flow from the load sense passage to the drain passage.

11. The load sense hydraulic system of claim 1, wherein:

the flow inlet and first work port opens into the bore of the first hydraulic valve at the flow portion of the first hydraulic valve, and the spool further includes a first reduced diameter portion at the flow portion that is configured to selectively fluidly connect the flow inlet to the first work port.

12. The load sense hydraulic system of claim 11, wherein a second work port of the first hydraulic valve opens into the bore at the flow portion of the first hydraulic valve, and wherein the spool is axially moveable in the bore and includes a second reduced diameter portion at the flow portion that is configured to selectively fluidly connect the flow inlet to the second work port.

13. The load sense hydraulic system of claim 1, wherein the first hydraulic valve has a second flow position, and wherein in the second flow position the first hydraulic valve opens the flow portion of the first hydraulic valve, allowing flow from the first work port of the first hydraulic valve to a tank return of the first hydraulic valve.

14. The load sense hydraulic system of claim 1, wherein in the flow position the first hydraulic valve opens the flow portion of the first hydraulic valve, allowing flow from a second work port of the first hydraulic valve to a tank return of the first hydraulic valve.

15. A method of venting a load sense passage in a load sense hydraulic system comprising:

allowing flow from the load sense passage to a reservoir via a drain passage when a first flow control valve is in a neutral position, wherein the first flow control valve includes (i) a body defining a bore, (ii) a spool axially movable in the bore and including a reduced diameter portion extending axially along an exterior surface of the spool, (iii) an upstream load sense drain opening configured to be fluidly coupled to the load sense passage and formed as a first annular groove disposed in an interior surface of the body, and (iv) a downstream load sense drain opening configured to be coupled to the drain passage and formed as a second annular groove disposed in the interior surface of the body and axially spaced from the first annular groove, and wherein in the neutral position, the reduced diameter portion of the spool forms an axially extending flow passage having a first end that partially overlaps with the first annular groove and a second end that partially overlaps with the second annular groove, thereby fluidly coupling the upstream load sense drain opening to the downstream load sense drain opening and allowing flow from the load sense passage via the drain passage to the reservoir; and preventing flow from the load sense passage to the reservoir via the drain passage when the first flow control valve is in a flow-allowing position.

16. The method of claim 15, wherein the load sense hydraulic system includes one or more additional flow control valves, wherein allowing flow from the load sense passage to the reservoir via the drain passage includes allowing flow when the first flow control valve and the one or more additional flow control valves are in the neutral position; and wherein preventing flow from the load sense passage to the reservoir includes preventing flow when any one of the first flow control valve and the one or more additional flow control valves is in the flow-allowing position.

* * * * *